US010300502B2

(12) United States Patent
Tada et al.

(10) Patent No.: US 10,300,502 B2
(45) Date of Patent: May 28, 2019

(54) PUMP DISPENSER

(71) Applicant: CANYON CORPORATION, Tokyo (JP)

(72) Inventors: Tetsuya Tada, Tokyo (JP); Mitsuaki Shaduki, Sanyo Onoda (JP)

(73) Assignee: CANYON CORPORATION, Tokyo (JP)

( * ) Notice: Subject to any disclaimer, the term of this patent is extended or adjusted under 35 U.S.C. 154(b) by 0 days.

(21) Appl. No.: 15/580,536

(22) PCT Filed: Jun. 1, 2016

(86) PCT No.: PCT/JP2016/002659
§ 371 (c)(1),
(2) Date: Dec. 7, 2017

(87) PCT Pub. No.: WO2016/199382
PCT Pub. Date: Dec. 15, 2016

(65) Prior Publication Data

US 2018/0185866 A1 Jul. 5, 2018

(30) Foreign Application Priority Data

Jun. 8, 2015 (JP) ..... 2015-116180

(51) Int. Cl.
*B05B 11/00* (2006.01)
*F04B 53/00* (2006.01)
(Continued)

(52) U.S. Cl.
CPC ..... *B05B 11/3066* (2013.01); *B05B 11/3011* (2013.01); *B05B 11/3057* (2013.01);
(Continued)

(58) Field of Classification Search
CPC ..... B05B 15/63; B05B 11/3066; B05B 11/00; B05B 11/3011; B05B 11/3057;
(Continued)

(56) References Cited

U.S. PATENT DOCUMENTS

2008/0017670 A1* 1/2008 Tada ..... B05B 11/0075 222/321.8
2010/0243680 A1* 9/2010 Tada ..... B05B 11/3011 222/383.1
2010/0276454 A1* 11/2010 Espinoza ..... B05B 11/3011 222/153.13

FOREIGN PATENT DOCUMENTS

JP 2015-51398 A 3/2015

OTHER PUBLICATIONS

International Search Report from corresponding PCT application No. PCT/JP2016/002659.

* cited by examiner

*Primary Examiner* — Patrick M. Buechner
*Assistant Examiner* — Robert K Nichols, II
(74) *Attorney, Agent, or Firm* — Muncy, Geissler, Olds & Lowe, P.C.

(57) ABSTRACT

[Object] To provide a pump dispenser which allows accurate determination of a direction of spraying of liquid without a nozzle part moving toward a higher or lower position and, furthermore, whose trigger is excellent in operability.
[Solution] The present invention is directed to an F valve attachment structure for, in a pump dispenser that causes a piston part to slide to apply pressure to liquid inside a cylinder part including an F valve and causes the liquid to squirt out from a nozzle part via an S valve, attaching the F valve to the inside of the cylinder part with use of a valve stopper, the F valve including: a valve body part; and a rod-like part extending upward from the valve body part,
(Continued)

wherein the valve body part has a plurality of guide pieces and check pieces therearound, the valve stopper has a hole and notches in a ceiling part of the valve stopper, the notches allowing the guide pieces to pass through the notches, the valve stopper is fixable inside the cylinder part, when the valve body part of the F valve is inserted through the hole of the valve stopper, the check pieces are allowed to elastically pass through the hole, and after insertion, the check pieces of the F valve come into contact with the ceiling part of the valve stopper to be retained.

7 Claims, 10 Drawing Sheets

(51) Int. Cl.

| | |
|---|---|
| ***B05B 15/63*** | (2018.01) |
| ***F04B 9/14*** | (2006.01) |
| ***F04B 53/10*** | (2006.01) |
| *F04B 23/02* | (2006.01) |

(52) U.S. Cl.
CPC ..... *B05B 11/3059* (2013.01); *B05B 11/3067* (2013.01); *B05B 11/3094* (2013.01); *B05B 15/63* (2018.02); *F04B 9/14* (2013.01); *F04B 53/00* (2013.01); *F04B 53/10* (2013.01); *F04B 23/028* (2013.01)

(58) Field of Classification Search
CPC ..... B05B 11/3059; F04B 9/14; F04B 53/00; F04B 53/10; F04B 23/028
USPC ..... 222/383.1
See application file for complete search history.

PUMP DISPENSER

TECHNICAL FIELD

The present invention relates to a pump dispenser which allows accurate determination of a direction of spraying of liquid without a nozzle part moving toward a higher or lower position and, furthermore, whose trigger is excellent in operability.

BACKGROUND ART

Conventionally, there has been widespread use of trigger-type pump dispensers as devices that are attached to containers to cause liquid inside the containers to be discharged or sprayed.

Such a trigger-type pump dispenser has a basic structure including a piston and a cylinder and, by causing the piston to move to apply pressure to liquid inside the cylinder, causes the liquid to be sprayed through a nozzle.

Such trigger-type pump dispensers are classified into several types according to how their pistons move.

These types include, for example, a type of trigger-type pump dispenser whose trigger, provided in front, is pulled backward with a finger.

Moving the trigger backward by squeezing it with a hand causes the piston to be depressed in step with the movement of the trigger to raise the pressure of liquid inside the cylinder.

This in turn causes the liquid to be sprayed with force through the nozzle.

Further, there has been proposed a type of trigger-type pump dispenser including a main body and a trigger disposed above the main body, wherein liquid inside a cylinder is pressurized by pressing in a back end of the trigger part downward and depressing a piston in step with the movement of the trigger part (see PTL 1).

This trigger-type pump dispenser is intended to pursue usability by identifying a positional relationship between a handle part and the trigger part.

That is, this is a type of trigger-type pump dispenser that causes liquid inside the cylinder part to be sprayed through a nozzle by depressing the trigger part, which is located above the handle part, with the handle part being gripped and that is characterized in that a portion of the handle part with which a finger comes into contact is located closer to the back than the point of the trigger part where force is applied.

However, in this trigger-type pump dispenser, too, depressing one side of the trigger part downward while gripping the handle part causes the piston part to move downward, too, accordingly.

In this case, the downward movement of the piston part causes the nozzle part to move downward, too.

Therefore, in spraying liquid, the nozzle part moves toward higher and lower positions. This presents a drawback of making it difficult to aim at a target.

Given this situation, the inventors of the present application added further improvements and developed, as Japanese Patent Application 2014-151134, a trigger-type pump dispenser that makes it easy to aim at a target without a nozzle part moving toward a higher or lower position.

CITATION LIST

Patent Literature

PTL 1: Japanese Patent Application Laid-Open No. 2015-51398

SUMMARY OF INVENTION

Technical Problem

However, although this trigger-type pump dispenser is excellent in terms of making it easy to aim at a target, as the nozzle does not move toward a higher or lower position and can therefore be kept fixed in place, it presents a drawback of letting the liquid inside the cylinder be sprayed through the nozzle under instantaneous pressure in a case where an operation of depressing the trigger with a finger is performed.

In other words, the absence of play in the movement to depress the trigger makes the trigger too effective in spraying, thus presenting such a shortcoming that a hard touch is felt during operation.

That is, in a case where the operation of depressing the trigger is performed, the trigger receives instantaneous reactive force from the pressure of the liquid, so that a so-called soft touch is not effected.

Thus, from the point of view of operability, satisfaction has not necessarily been attained.

The present invention has been made on the basis of such background art and has as an object to provide a trigger-type pump dispenser which allows accurate determination of a direction of spraying of liquid without a nozzle part moving toward a higher or lower position and, furthermore, whose trigger is excellent in operability.

Solution to Problems

The inventors and others diligently studied to solve the foregoing problems and found that the foregoing problems can be solved by employing an attachment structure that has play with respect to an F valve, and thus accomplished the present invention.

That is, the present invention is directed to (1) an F valve attachment structure for, in a pump dispenser that causes a piston part to slide to apply pressure to liquid inside a cylinder part including an F valve and causes the liquid to squirt out from a nozzle part via an S valve, attaching the F valve to the inside of the cylinder part with use of a valve stopper, the F valve including: a valve body part; and a rod-like part extending upward from the valve body part, wherein the valve body part has a plurality of guide pieces and check pieces therearound, the valve stopper has a hole and notches in a ceiling part of the valve stopper, the notches allowing the guide pieces to pass through the notches, the valve stopper is fixable inside the cylinder part, when the valve body part of the F valve is inserted through the hole of the valve stopper, the check pieces are allowed to elastically pass through the hole, and after insertion, the check pieces of the F valve come into contact with the ceiling part of the valve stopper to be retained.

Further, the present invention is directed to (2) the F valve attachment structure according to (1), wherein the valve body part has a disk-shaped valve that is able to make contact with or move away from a valve seat formed on a bottom surface of the cylinder part.

Further, the present invention is directed to (3) the F valve attachment structure according (1), wherein the guide pieces of the F valve consist of four guide pieces provided in a radial fashion around the valve body part, and the notches of the valve stopper consist of four notches corresponding to the four guide pieces of the F valve.

Further, the present invention is directed to (4) the F valve attachment structure according (1), wherein the check pieces consist of two check pieces provided around the valve body part.

Further, the present invention is directed to (5) the F valve attachment structure according (1), wherein the valve stopper is press fixed to the cylinder part by a spring.

Further, the present invention is directed to (6) the F valve attachment structure according to (1), wherein the guide pieces are elastically provided outwardly.

Further, the present invention is directed to (7) the F valve attachment structure according to (1), wherein the F valve reaches its lower limit in a state where the valve body is in contact with a valve seat formed on a bottom surface of the cylinder part, and the F valve reaches its upper limit in a state where the check pieces are in contact with the ceiling part of the valve stopper.

It should be noted that a configuration based on a proper combination of configurations of the inventions described above can be employed, provided such a configuration fits the purpose of the present invention.

Advantageous Effects of Invention

The trigger-type pump dispenser according to the present invention brings about the following effects.

Since even an upward or downward rotation of the trigger causes no change in position of the nozzle part, it is possible to accurately determine a direction of spraying of liquid aimed at a target.

Before the trigger 5 is depressed, the F valve FV is open (that is, the valve is at a certain distance from the valve seat of the bottom of the cylinder part), and even when the trigger 5 is depressed, it takes a certain, albeit very short, period of time for the valve d to come into contact with the valve seat of the bottom of the cylinder part 11. This prevents the trigger 5 from suddenly receiving the reaction force.

This causes there to be so-called "play" in the movement of the trigger 5 in spraying the liquid.

That is, even when the trigger 5 is depressed, pressure is applied to the liquid not suddenly but with a time lag, as the F valve FV is initially not closed. This prevents the liquid from being instantaneously sprayed through the nozzle part 2.

Thus, the trigger 5 does not suddenly receive the reaction force. This causes there to be play in the movement of the trigger 5, thus achieving excellent operability.

Further, the insertion of the stopper member 10 between the trigger 5 and the inverted L-shaped handle part makes it possible to prevent the trigger 5 from being depressed for any reason during storage or transportation of the trigger-type pump dispenser.

DESCRIPTION OF EMBODIMENTS

A trigger-type pump dispenser A according to an embodiment of the present invention is described below with reference to the drawings.

A pump dispenser of the invention set forth in the present application is a pump dispenser that causes a piston part to slide to apply pressure to liquid inside a cylinder part including an F valve and causes the liquid to squirt out from a nozzle part via an S valve.

Further, the F valve is attached to the inside of the cylinder part via a valve stopper.

Here, first, an overview of the pump dispenser is provided.

Figure 1:
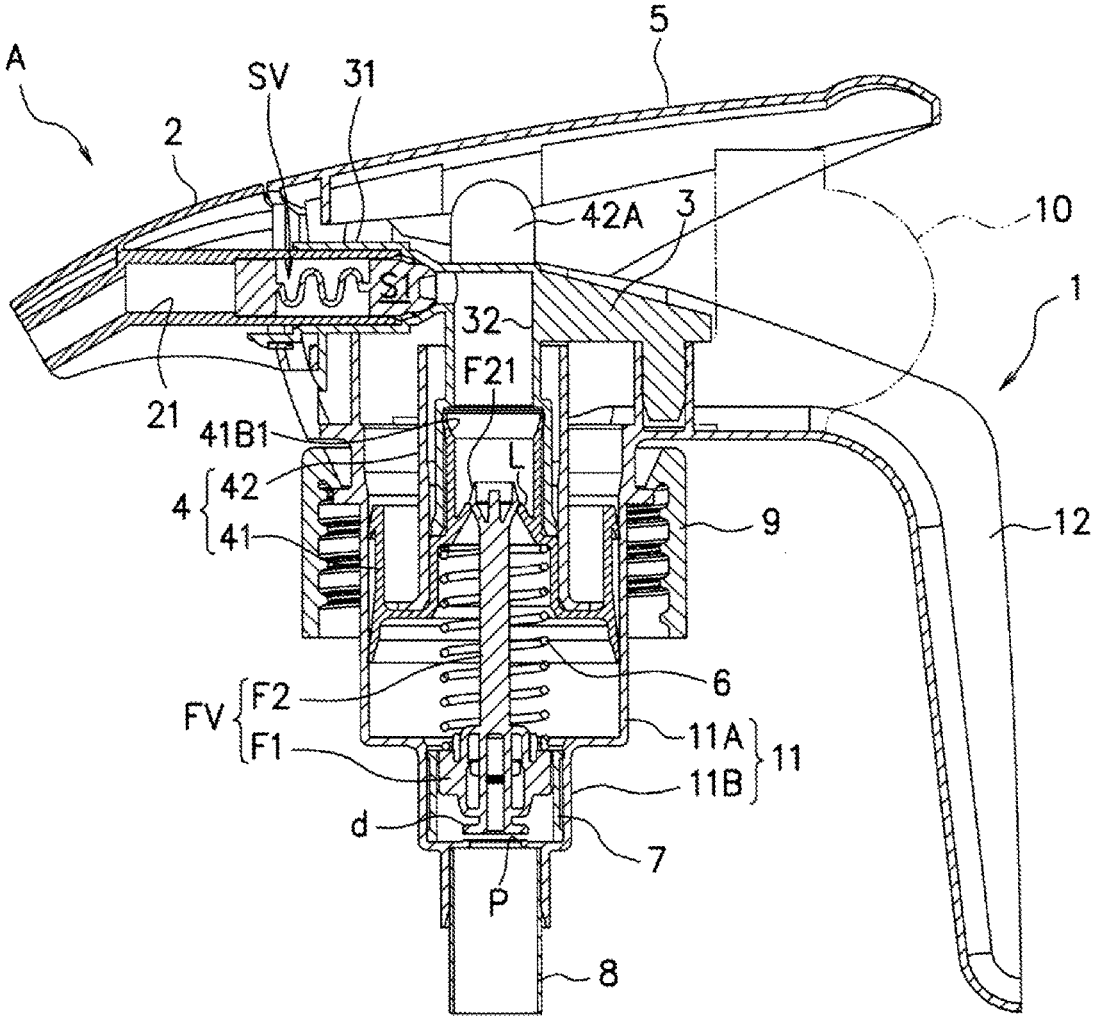
FIG. 1 is a longitudinal sectional view of a trigger-type pump dispenser according to an embodiment of the present invention, with a stopper member inserted between a trigger and an inverted L-shaped handle part.

FIG. 1 is a longitudinal sectional view of a trigger-type pump dispenser according to an embodiment of the present invention, with a stopper member inserted between a trigger and an inverted L-shaped handle part.

Figure 2:
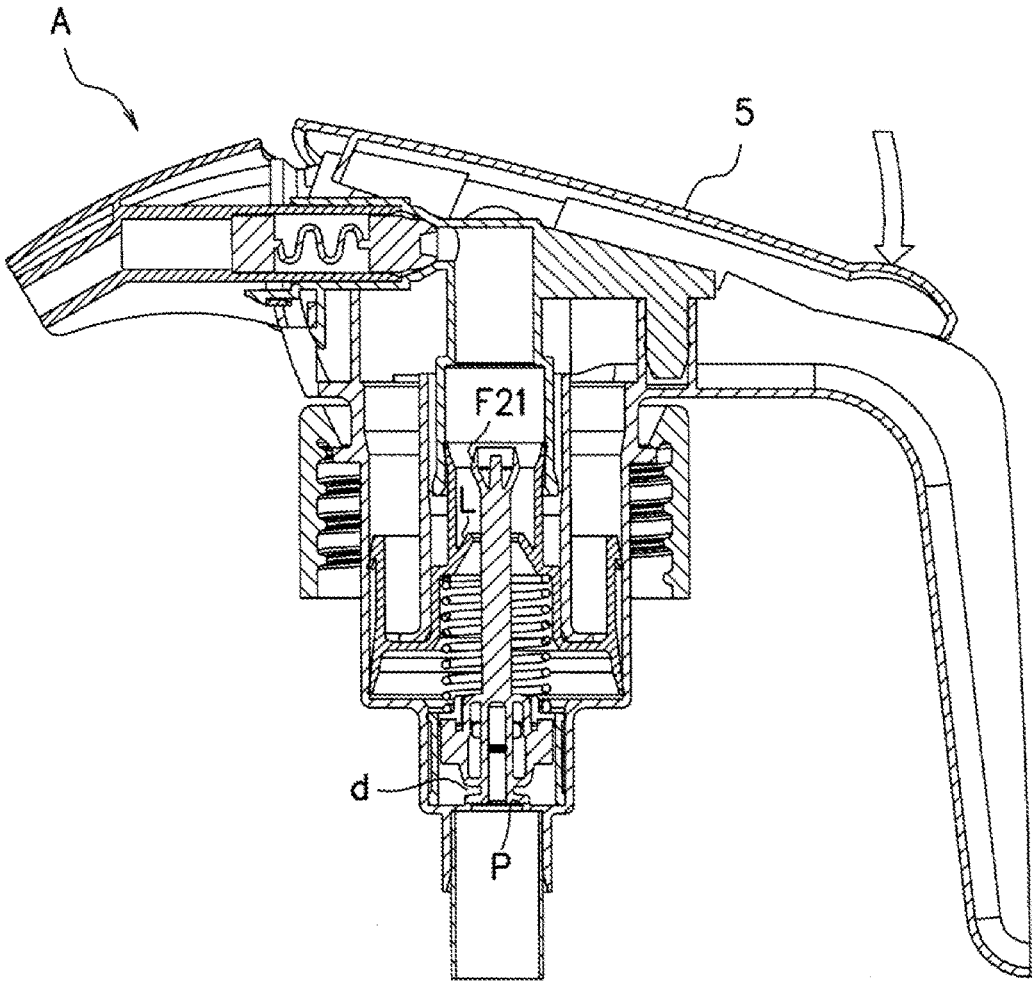
FIG. 2 is a longitudinal sectional view of a trigger-type pump dispenser according to an embodiment of the present invention, with a trigger having been rotated.

FIG. 2 is a longitudinal sectional view of a trigger-type pump dispenser according to an embodiment of the present invention, with a trigger having been rotated.

As illustrated, the trigger-type pump dispenser A according to the embodiment of the present invention includes a housing (i.e. a cylinder part 11 and a handle part 12) 1, a nozzle part 2 and a nozzle base 3, a piston structure (i.e. a hollow piston 41 and a hollow piston shaft 42), a trigger 5 and a spring 6, an S valve SV and an F valve FV, a valve stopper 7, a tube 8, and a cap 9.

First, the housing 1 is one made by integrally forming the cylinder part 11 and the handle part 12. The cylinder part 11 is located on the front side and has a stepped cylindrical shape. The handle part 12 is located on the back side and has an inverted L shape.

Further, the after-mentioned nozzle base 3 is attached to the housing 1.

The cylinder part 11 has a large-diameter portion 11A and a medium-diameter portion 11B, and the piston structure 4 applies pressure to liquid by sliding inside this cylinder part 11 (in particular the large-diameter portion 11A).

The large-diameter portion 11A has a rib formed on the upper periphery thereof, and the trigger-type pump dispenser per se can be attached to a container by compressing this rib with the after-mentioned cap 9.

The handle part 12 is located so as to correspond to a lower position than a thumb rest located at a back end of the after-mentioned trigger 5.

Figure 3A:
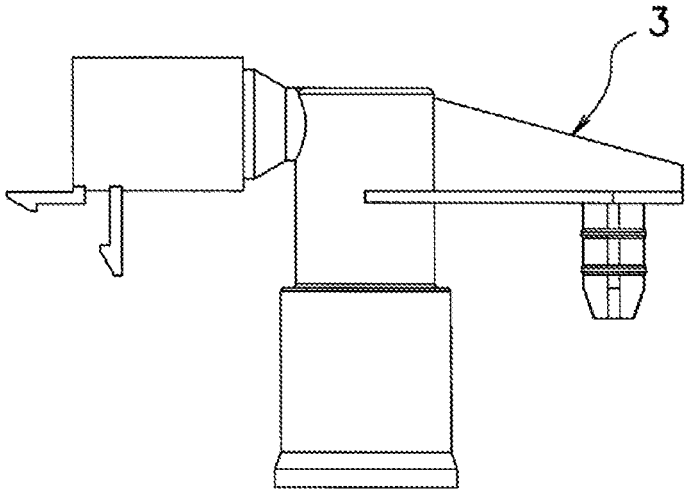
FIG. 3 illustrates (A) a front view and (B) a longitudinal sectional view of a nozzle base that is used in a trigger-type pump dispenser according to an embodiment of the present invention.
Figure 3B:
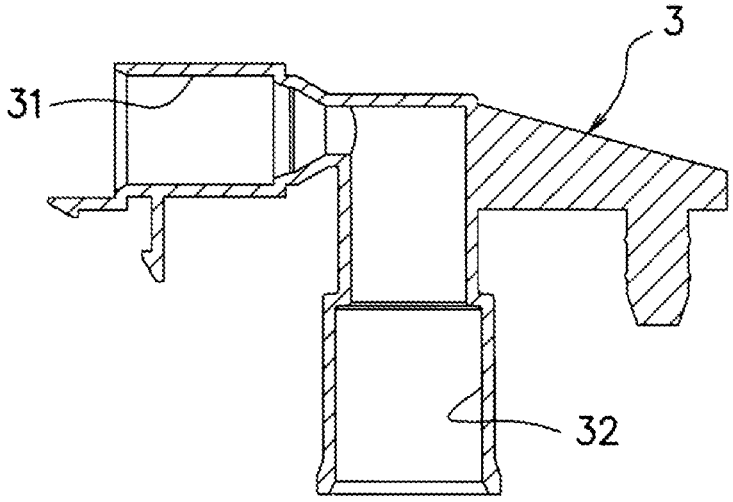

FIG. 3 illustrates (A) a front view and (B) a longitudinal sectional view of a nozzle base that is used in a trigger-type pump dispenser according to an embodiment of the present invention.

The nozzle base 3 has a transverse hollow portion 31 in the front thereof and has a longitudinal hollow portion 32 in the center thereof.

The nozzle part 2 is press fitted into the front of this nozzle base 3.

The nozzle part 2 has a hollow cylindrical portion 21 containing a second valve SV having a valve body S1.

It should be noted that the valve body S1 of this second valve SV is pressed against the bottom (which functions as a valve seat) of the transverse hollow portion 31 of the nozzle base 3.

Figure 4A:
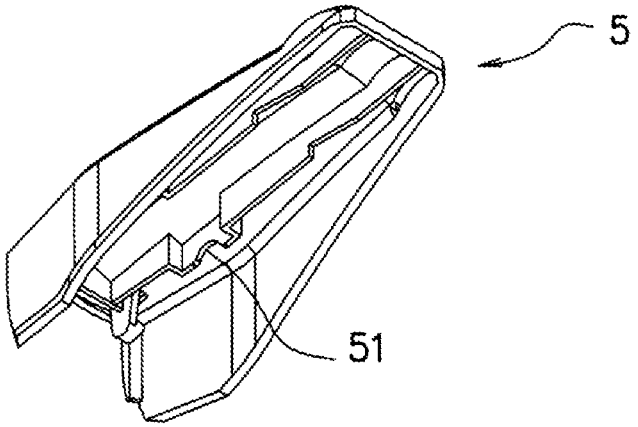
FIG. 4 illustrates (A) a bottom perspective view and (B) an inside-out bottom perspective view of a trigger that is used in a trigger-type pump dispenser according to an embodiment of the present invention.
Figure 4B:
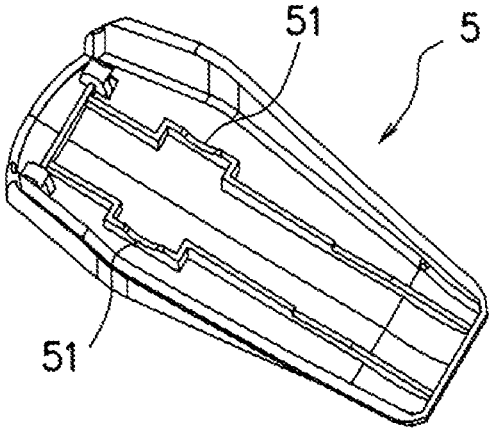

FIG. 4 illustrates (A) a bottom perspective view and (B) an inside-out bottom perspective view of a trigger that is used in a trigger-type pump dispenser according to an embodiment of the present invention.

The trigger 5 is located above the housing 1 and has its front end rotatably coupled via an attachment hole of the housing 1.

Further, the trigger 5 has arc recesses 51 (in two places) on a back surface thereof.

Moreover, spindles 42B (two) formed at a bifurcated portion 42A of the after-mentioned hollow piston shaft 42 come into contact with these arc recesses 51 (pair).

The point where these spindles 42B (two) come into contact, i.e. the arc recesses 51 (pair) of the trigger 5, serves as a point of application P2.

Figure 5A:
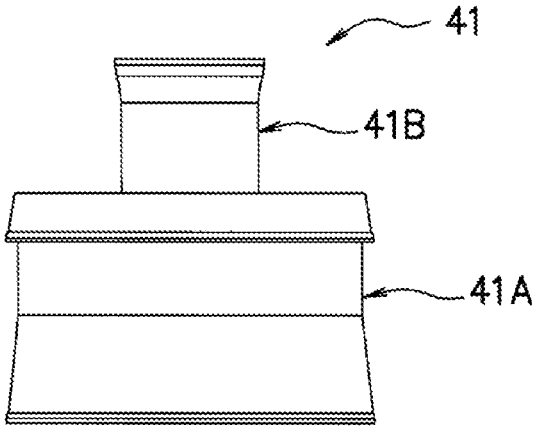
FIG. 5 illustrates (A) a front view and (B) a longitudinal sectional view of a piston portion that is used in a trigger-type pump dispenser according to an embodiment of the present invention.
Figure 5B:
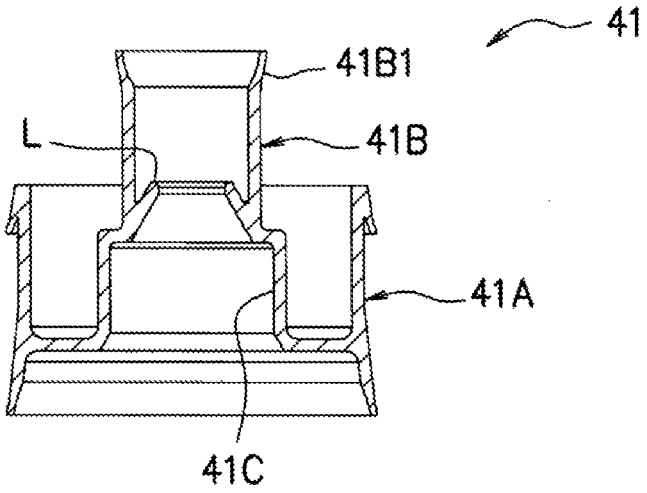

FIG. 5 illustrates (A) a front view and (B) a longitudinal sectional view of a piston portion that is used in a trigger-type pump dispenser according to an embodiment of the present invention.

Figure 6A:
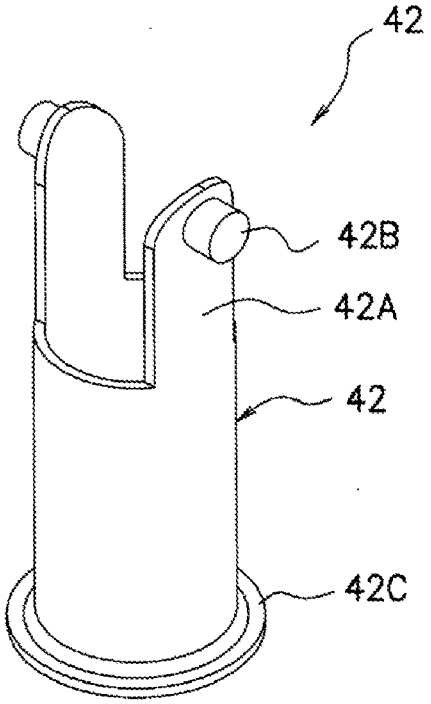
FIG. 6 illustrates (A) a perspective view and (B) a longitudinal sectional view of a piston shaft that is used in a trigger-type pump dispenser according to an embodiment of the present invention.
Figure 6B:
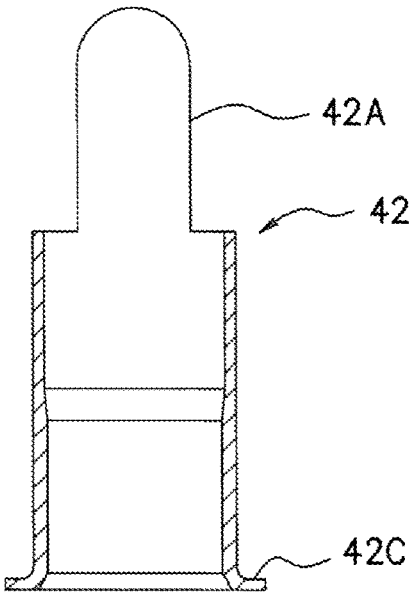

FIG. 6 illustrates (A) a perspective view and (B) a longitudinal sectional view of a piston shaft that is used in a trigger-type pump dispenser according to an embodiment of the present invention.

Figure 7A:
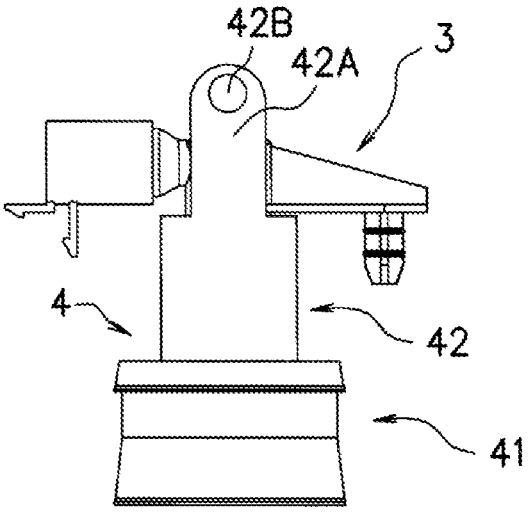
FIG. 7 illustrates (A) a front view and (B) a longitudinal sectional view of an assembly of a nozzle base, a piston, and a piston shaft that are used in a trigger-type pump dispenser according to an embodiment of the present invention.
Figure 7B:
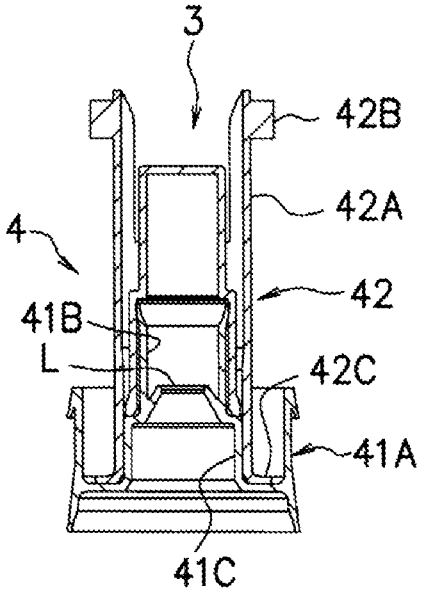

FIG. 7 illustrates (A) a front view and (B) a longitudinal sectional view of an assembly of a nozzle base and a piston structure (i.e. a piston and a piston shaft) that are used in a trigger-type pump dispenser according to an embodiment of the present invention.

The piston structure 4 is composed of the hollow piston 41 and the hollow piston shaft 42.

Moreover, the piston shaft 42 is fixed to the piston 41 by press fitting so that they are integrated with each other.

First, as illustrated, the piston portion 41 is integrally formed so that a large-diameter piston portion 41A, a small-diameter piston portion 41B, and a medium-diameter middle portion 41C connecting the large-diameter piston portion 41A and the small-diameter piston portion 41B have a common axis.

Moreover, the small-diameter piston portion 41B has an upward lip L formed on the lower inside thereof (i.e. between the small-diameter piston portion 41B and the medium-diameter middle portion 41C).

This lip L reduces the diameter of a passage of liquid.

Further, the small-diameter piston portion 41B has an increasing diameter portion 41B1 formed at an upper end thereof. The diameter of the increasing diameter portion 41B1 gradually becomes larger outward.

The small-diameter piston portion 41B is slidably inserted in the longitudinal hollow portion 32 of the nozzle base 3, and this outwardly-increasing diameter portion 41B1 fulfills a sealing function.

This allows the space between the cylinder part 11 and the nozzle base 3 to be sealed against the outside.

As will be mentioned later, in a case of operating the trigger 5 to spray liquid, the piston portion 41 including this small-diameter piston portion 41B moves up and down, but the nozzle base 3 per se does not move up or down.

Therefore, the nozzle part 2 fitted in the nozzle base 3 does not move, so that there is no upward or downward change in position of the nozzle part 2.

Further, the large-diameter piston portion 41A of the piston portion 41 is slidably inserted in the large-diameter portion 11A of the cylinder part 11.

The piston shaft 42 has the bifurcated portion 42A formed as an upper portion thereof.

Further, the spindles 42B (pair) project from upper outer surfaces of the bifurcated portion 42A.

These spindles 42B (pair) are in contact with the arc recesses 51 (pair) of the aforementioned trigger 5.

Moreover, this point of contact serves as a point of application at which the trigger 5 moves.

As illustrated, the lower part of the piston shaft 42 has a flange portion 42C formed outwardly at a lower end thereof, and is press fitted between the medium-diameter middle portion 41C and the large-diameter piston portion 41A of the aforementioned piston portion 41.

The spring 6 biases the entire piston structure 4, composed of the hollow piston portion 41 and the hollow piston shaft 42, upward.

The spring 6 has its upper end in contact with a stepped portion between the small-diameter piston portion 41B and the medium-diameter middle portion 41C.

Further, the spring 6 has its lower end in contact with an upper surface of the after-mentioned valve stopper 7 to bias the valve stopper 7 downward.

Moreover, rotating the trigger 5 by depressing it with a thumb causes the piston structure 4 to move downward, so that the spring 6 is compressed.

Further, releasing the finger from the trigger 5 causes the spring 6 to expand to bias the piston structure 4 upward.

Moreover, the upward biasing of the piston structure 4 causes the spindles 42B of the piston shaft 42 to be pushed up, so that the trigger 5, which is in contact with the spindles 42B, is pushed up to return to its original position.

Thus, the spring 6 fulfills the function for the trigger 5 to surely return.

Incidentally, with the trigger-type pump dispenser attached to a container, liquid inside the container is sucked up via an F valve FV provided inside the cylinder part.

The F valve FV is attached to the cylinder part 11 via the valve stopper 7.

The following describes a relationship between this F valve FV and the valve stopper 7.

Figure 8A:
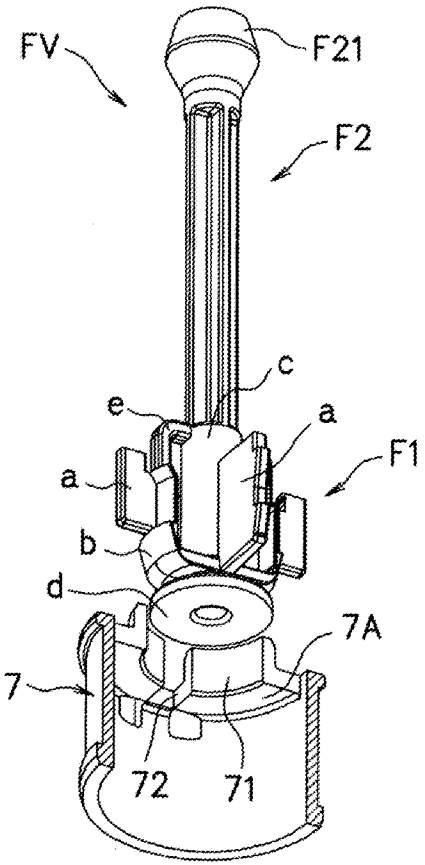
FIG. 8 illustrates (A) a partially cross-sectional bottom perspective view, (B) a top perspective view, and (C) a longitudinal sectional view of an F valve and a valve stopper that are used in a trigger-type pump dispenser according to an embodiment of the present invention.
Figure 8B:
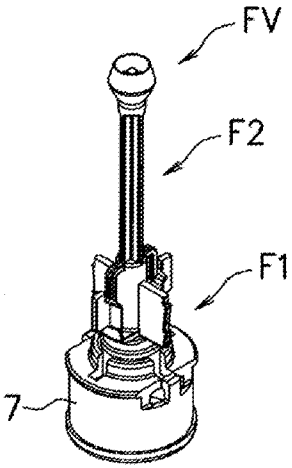
Figure 8C:
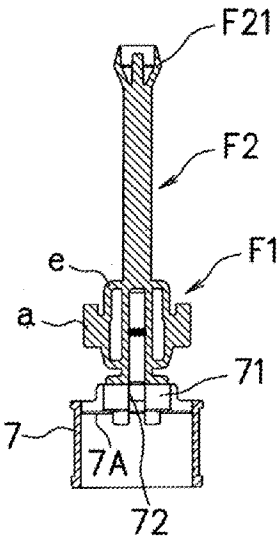

FIG. 8 illustrates (A) a bottom perspective view, (B) a top perspective view, and (C) a longitudinal sectional view of an F valve and a valve stopper that are used in a trigger-type pump dispenser according to an embodiment of the present invention.

Figure 9A:
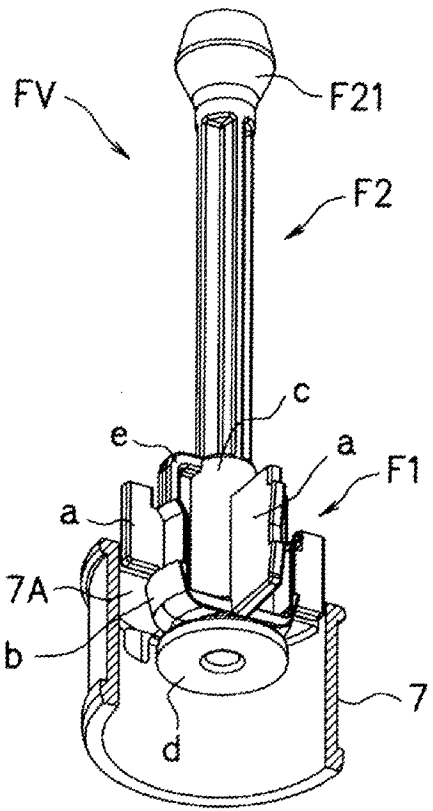
FIG. 9 illustrates (A) a partially cross-sectional bottom perspective view, (B) a top perspective view, and (C) a longitudinal sectional view of an F valve and a valve stopper that are used in a trigger-type pump dispenser according to an embodiment of the present invention.
Figure 9B:
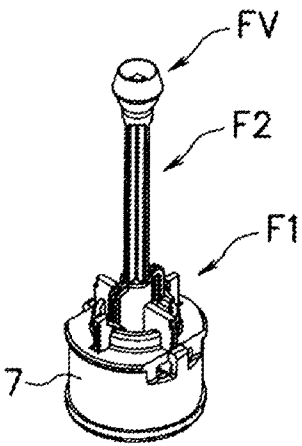
Figure 9C:
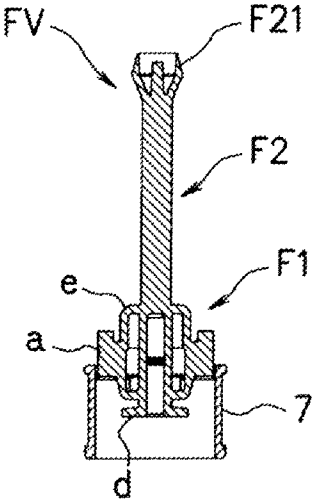

FIG. 9 illustrates (A) a bottom perspective view, (B) a top perspective view, and (C) a longitudinal sectional view of an F valve and a valve stopper that are used in a trigger-type pump dispenser according to an embodiment of the present invention.

Figure 10A:
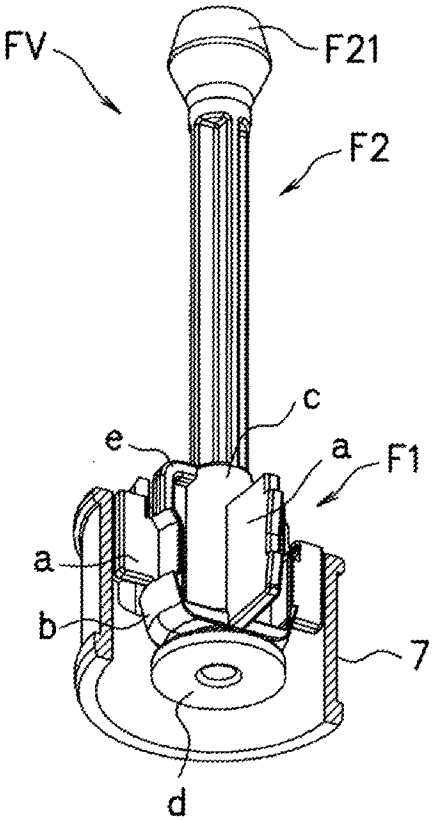
FIG. 10 illustrates (A) a partially cross-sectional bottom perspective view, (B) a partially cross-sectional top perspective view, and (C) a longitudinal section of an F valve and a valve stopper that are used in a trigger-type pump dispenser according to an embodiment of the present invention.
Figure 10B:
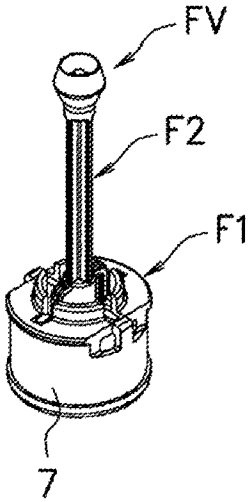
Figure 10C:
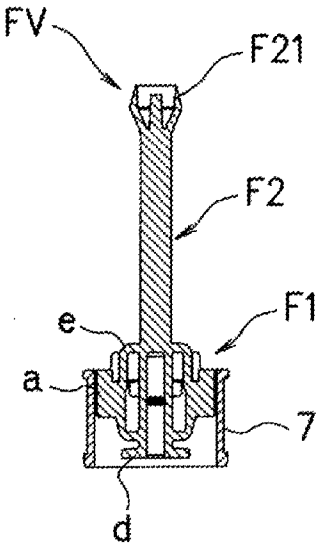

FIG. 10 illustrates (A) a bottom perspective view, (B) a top perspective view, and (C) a longitudinal sectional view of an F valve and a valve stopper that are used in a trigger-type pump dispenser according to an embodiment of the present invention.

The F valve is described here.

The F valve FV includes a valve body part F1 and a rod-like part F2 extending upward from the valve body part F1 and, in a state of being incorporated in the trigger-type pump dispenser, is attached via the after-mentioned valve stopper 7.

The valve body part F1 has a plurality of guide pieces a and check pieces b therearound.

These pieces include a pair of (i.e. two) check pieces b provided on the right and left sides, respectively, in the drawings and two pairs of (i.e. four) guide pieces a provided on the front, back, right, and left sides, respectively.

Of these guide pieces a, the front and back guide pieces a stand radially from a cylindrical base portion c of the valve body part F1.

Further, the valve body part F1 has a valve d provided at a lower end thereof.

This valve d faces an annularly-projecting portion P (i.e. a portion that functions as a valve seat) slightly projecting upward from the bottom of the medium-diameter portion 11B of the cylinder part 11.

The valve d of the F valve FV opens by moving away from this annularly-projecting portion P and, conversely, closes by making contact with this annularly-projecting portion P.

Meanwhile, the check pieces b are provided on the right and left sides of the cylindrical base portion c or, specifically, are provided on an elastic support portion e extending in a bridge manner from the cylindrical base portion c.

These right and left check pieces b have returns provided at outer ends thereof.

Further, the right and left guide pieces a are provided on this elastic support portion e extending in a bridge manner, too.

Meanwhile, the rod-like part F2, which extends upward from the valve body part F1, has an enlarged portion F21 provided at a tip thereof to fulfill a sealing function in cooperation with the lip L of the small-diameter piston portion 41B described earlier.

The valve stopper 7 is described here.

The valve stopper 7 has a cylindrical shape, has a hole 71 and notches 72 in a ceiling part 7A of the valve stopper 7, and can be fitted into the cylinder part. The notches 72 allow the guide pieces a of the F valve to pass through the notches 72.

It should be noted that in a state of being fitted in the cylinder part, the valve stopper 7 is pressed by the spring 6 as described previously.

That is, the valve stopper 7 is press fixed.

Incidentally, the F valve FV and the valve stopper 7 are individually and simultaneously molded by injection molding with use of divided molds. When they are released from the molds, they are incorporated into each other.

That is, when the F valve F and the valve stopper 7 are released from the molds, they are attached to each other by pressing the F valve FV into the valve stopper 7 in a direction of axis.

FIGS. 8, 9, and 10 provide a clear understanding of an aspect in which the valve body part F1 of the F valve FV is inserted into the hole 71 of the valve stopper 7 in this order.

Specifically, when the valve body part F1 of the F valve FV is inserted into the valve stopper 7 through the hole 71, the check pieces b elastically bend inward, so that the valve body part F1 is easily inserted.

However, once the valve body part F1 is inserted, no amount of effort to withdraw the F valve FV from the valve stopper 7 allows the F valve FV to withdraw, as such effort results in the check pieces b having their ends coming into contact with the ceiling part 7A.

This means that in a state where the F valve FV is incorporated in the trigger-type pump dispenser, the valve stopper 7 defines an upper limit of movement of the F valve FV.

It should be noted that since the F valve FV and the valve stopper 7 are attached to each other right after they have been molded, they do not separate from each other and are prevented from being lost.

In a state after removal from the molds, the ceiling part 7A of the valve stopper 7 is caught on the check pieces b of the F valve FV in a hanging manner.

Therefore, dropping the F valve FV into the medium-diameter portion 11B of the cylinder part 11 in this state causes the F valve FV to be fitted into the cylinder part.

It should be noted that the tube 8 is attached by being inserted into a cylindrical portion projecting downward from the cylinder part 11.

Moreover, the aforementioned F valve FV is located above an upper end of the tube 8.

The cap 9 is used for attaching the housing 1 to a container, and as described previously, the rib of the housing 1 is utilized, for example, to screw the cap 9 onto the mouth of a container.

It should be noted here that, as for materials constituting the trigger-type pump dispenser, it is preferable that the piston 41 be made of polyethylene and the housing 1, the nozzle base 3, the trigger 5, the piston shaft 42, the F valve FV, the tube 8, the cap 9, and the stopper member 10 all be made of polypropylene.

The following describes operation of the trigger-type pump dispenser A according to the embodiment of the present invention.

First, the stopper member 10 (see FIG. 1) is removed, so that the trigger 5 is brought into a depressable state.

At this point in time, as shown in FIG. 1, the F valve FV is open; that is, the valve d is at a certain distance (T) from the annularly-projecting portion P of the bottom of the medium-diameter portion 11B of the cylinder part 11.

Further, the enlarged portion F21 provided at the tip of the F valve FV is in contact with the lip L formed on the lower inside of the small-diameter piston portion 41B.

Now, as shown in FIG. 2, the handle part 12 is gripped, and the trigger 5 is depressed with a thumb.

Then, in step with the movement of the trigger 5, the piston structure 4 (i.e. the piston shaft 42 and the piston portion 41) moves downward against the resilience of the spring 6.

This raises the pressure of liquid inside the large-diameter portion 11A and the medium-diameter portion 11B of the cylinder part 11.

Moreover, since the F valve FV is initially open (that is, the valve d of the F valve FV is at a clearance from the annularly-projecting portion P of the bottom of the cylinder part 11), part of the liquid inside the cylinder part passes through this clearance and flows into a container body (not illustrated) located therebelow.

Next, a further downward movement of the piston stricture 4 then brings the valve d of the F valve FV into contact with the annularly-projecting portion P of the bottom of the cylinder part 11, so that the F valve FV becomes closed.

At this point in time, the enlarged portion F21 of the rod-like part F2 comes out of contact with the lip L of the small-diameter piston portion 41B, so that the large-diameter portion 11A of the cylinder part 11 communicates with the longitudinal hollow portion 32 of the nozzle base 3.

Therefore, a further downward movement of the piston structure 4 raises the pressure of liquid inside the longitudinal hollow portion 32, so that the S valve SV becomes open.

This causes the liquid to be sprayed forward through the nozzle part 2.

In this case, even when the rotation of the trigger 5 causes the piston 4 to move downward, the nozzle part 2 remains in place without moving.

Next, once the pressing force from the trigger 5 by the thumb is released, the resilience of the spring 6 causes the piston structure 4, composed of the piston shaft 42 and the piston part 41, to rise to return to its original position.

It should be noted that since the spindles 42B (two) of the piston shaft part 42 are in contact with the arc recesses 51 (in two places) of the trigger 5, the resilience of the spring 6 also causes the trigger 5 to rotate to return to its original position.

Since the rising of the piston part 41 makes the pressure inside the cylinder part negative, the S valve SV becomes closed and the F valve FV becomes open, so that the liquid inside the container body is sucked up via the tube 8.

When, at this point in time, the piston 4 rises to return to its original position (see FIG. 1), the enlarged portion F21 provided at the tip of the rod-like part F2 comes into contact with the lip L of the small-diameter piston portion 41B, so that the communication between the large-diameter portion 11A of the cylinder part 11 and the longitudinal hollow portion 32 of the nozzle base 3 is interrupted.

Therefore, in this state, inadvertent leakage of liquid to the outside can be prevented even in the presence of the application of an impact or the like. Then, the valve d of the valve body part F1 comes into contact with the annularly-projecting portion P of the bottom of the cylinder part 11.

The trigger-type pump dispenser A according to the embodiment of the present invention brings about the following effects.

Since even an upward or downward rotation of the trigger 5 causes no change in position of the nozzle part 2, it is possible to accurately determine a direction of spraying of liquid aimed at a target.

Before the trigger 5 is depressed, the F valve FV is open (that is, the valve d of the F valve FV is at a certain distance from the annularly-projecting portion P of the bottom of the cylinder part 11), and even when the trigger 5 is depressed, it takes a certain, albeit very short, period of time for the valve d to come into contact with the annularly-projecting portion P of the bottom of the cylinder part 11.

This prevents the trigger 5 from suddenly receiving the reaction force.

This causes the liquid to be sprayed with a delay of a certain period of time with respect to the movement of the trigger 5. This causes there to be so-called play in the movement, thus bringing about improvement in operability.

Further, the insertion of the stopper member 10 between the trigger 5 and the handle part 12 makes it possible to prevent the trigger 5 from being depressed for any reason during storage or transportation of the trigger-type pump dispenser A.

While a preferred embodiment of the present invention has been described above, the present invention is not limited to the above-described embodiment.

For example, although the valve body part F1 of the F valve includes the right and left guide pieces a therearound, the guide pieces a do not necessarily need to be provided on the elastic support portion e extending in a bridge manner from the cylindrical base portion c.

INDUSTRIAL APPLICABILITY

The present invention is applicable, for example, to the field of industries in general, medical devices, or the like for use in painting, provided the liquid spraying principle of the invention is utilized.

REFERENCE SIGNS LIST

1 . . . Housing
11 . . . Cylinder part
11A . . . Large-diameter portion
11B . . . Small-diameter portion
P . . . Annularly-projecting portion
12 . . . Handle part
2 . . . Nozzle part
31 . . . Transverse hollow portion
32 . . . Longitudinal hollow portion
3 . . . Nozzle base
4 . . . Piston structure
41 . . . Piston portion
41A . . . Large-diameter piston portion
41B . . . Small-diameter piston portion
41B1 . . . Increasing diameter portion
41C . . . Medium-diameter middle portion
L . . . Lip
42 . . . Piston shaft
42A . . . Bifurcated portion
42B . . . Spindle
42C . . . Flange portion
5 . . . Trigger
51 . . . Arc recess
6 . . . Spring
7 . . . Valve stopper
7A . . . Ceiling part
71 . . . Hole
72 . . . Notch
8 . . . Tube
9 . . . Cap
10 . . . Stopper member
FV . . . F valve
F1 . . . Valve body part
a . . . Guide piece
b . . . Check piece
c . . . Cylindrical base portion
d . . . Valve
e . . . Elastic support portion
F2 . . . Rod-like part
F21 . . . Enlarged portion
A . . . Trigger-type pump dispenser

The invention claimed is:

1. An F valve attachment structure, being used in a pump dispenser that causes a piston part to slide to apply pressure to liquid inside a cylinder part including an F valve and causes the liquid to squirt out from a nozzle part via an S valve, for attaching the F valve to the inside of the cylinder part with use of a valve stopper, the F valve comprising: a valve body part; and a rod-like part extending upward from the valve body part, wherein the valve body part has a plurality of guide pieces and check pieces therearound, the valve stopper has a hole and notches in a ceiling part of the valve stopper, the notches allowing the plurality of guide pieces to pass through the notches, the valve stopper is fixable inside the cylinder part, when the valve body part of the F valve is inserted through the hole of the valve stopper, the check pieces are allowed to elastically pass through the hole, and after insertion, the check pieces of the F valve come into contact with the ceiling part of the valve stopper to be retained within the valve stopper.

2. The F valve attachment structure according to claim 1, wherein the valve body part has a disk-shaped valve that is able to make contact with or move away from a valve seat formed on a bottom surface of the cylinder part.

3. The F valve attachment structure according to claim 1, wherein the plurality of guide pieces of the F valve consist of four guide pieces provided in a radial fashion around the valve body part, and the notches of the valve stopper consist of four notches corresponding to the four guide pieces of the F valve.

4. The F valve attachment structure according to claim 1, wherein the check pieces consist of two check pieces provided around the Valve body part.

5. The F valve attachment structure according to claim 1, wherein the valve stopper is press fixed to the cylinder part by a spring.

6. The F valve attachment structure according to claim 1, wherein the plurality of guide pieces are elastically provided outwardly.

7. The F valve attachment structure according to claim 1, wherein in a state where the valve body is in contact with a valve seat formed on a bottom surface of the cylinder part, the F valve reaches a lower limit at which the F valve ceases to be able to move further downward, and in a state where the check pieces are in contact with the ceiling part of the valve stopper, the F valve reaches an upper limit at which the F valve ceases to be able to move further upward.

* * * * *